US007146755B2

(12) United States Patent
Scanzani

(10) Patent No.: US 7,146,755 B2
(45) Date of Patent: Dec. 12, 2006

(54) PROCESS AND EQUIPMENT USED TO IRON THE EDGES OF SLASH POCKETS

(76) Inventor: Beniamino Scanzani, Via Imbrecciata, 37, I-60024 Filottrano (AN) (IT)

( * ) Notice: Subject to any disclaimer, the term of this patent is extended or adjusted under 35 U.S.C. 154(b) by 72 days.

(21) Appl. No.: 11/073,150

(22) Filed: Mar. 4, 2005

(65) Prior Publication Data

US 2006/0016106 A1 Jan. 26, 2006

(30) Foreign Application Priority Data

Jul. 26, 2004 (IT) ..... MC2004A000102

(51) Int. Cl.
*D06F 71/28* (2006.01)

(52) U.S. Cl. ..... 38/70

(58) Field of Classification Search ..... 38/1 R, 38/7, 12, 17, 20, 64, 1 B, 69, 70; 223/38, 223/42, 52.5, 52.6, 61, 72, 73, 74; 112/470.16
See application file for complete search history.

(56) References Cited

U.S. PATENT DOCUMENTS 2,642,209 A * 6/1953 Davis ..... 223/57
4,910,894 A * 3/1990 Vartan ..... 38/30
5,355,599 A * 10/1994 Spenneberg, Jr. ..... 38/141
5,454,336 A * 10/1995 Iwasaki ..... 112/470.16
6,038,796 A * 3/2000 Uchikoshi ..... 38/20

* cited by examiner

*Primary Examiner*—Ismael Izaguirre
(74) *Attorney, Agent, or Firm*—Armstrong, Kratz, Quintos, Hanson & Brooks, LLP

(57) ABSTRACT

The present invention refers to a process and machine used to automatically iron the edges of slash pockets, comprising an ironing station with a pair of ironing buffers one over the other and two pairs of threads used to support and keep the section of fabric folded correctly, it being held near a large window crossed by the threads and housing the two buffers, with one buffer over and one buffer under the ironing plane.

7 Claims, 3 Drawing Sheets

PROCESS AND EQUIPMENT USED TO IRON THE EDGES OF SLASH POCKETS

BACKGROUND OF THE INVENTION

1. Field of the Invention

The present patent application refers to a process used to automatically iron the edges of slash pockets, and also the machine used to implement said process.

2. Description of Related Art

The ironing operation is currently carried out by hand, and therefore the ironing process and machine of the invention are an absolute novelty.

SUMMARY OF THE INVENTION

The machine of the invention provides for a loading station for the items to be ironed and means to transfer them automatically to the ironing station, where two ironing buffers operate and are situated over and under the ironing plane.

The plane is characterised by the presence of a large window over which the item to be ironed is moved and held, partly supported by the lower ironing buffer and partly supported by threads with suitable orientation adapted to favour the perfect ironing of the fabric and avoid the creation of undesired folds.

For major clarity the description of the invention continues with reference to the enclosed drawings, which are intended for purposes of illustration only and not in a limiting sense, whereby:

DESCRIPTION OF THE PREFERRED EMBODIMENTS

For a better understanding of the invention, it is necessary to define the different parts of a slash pocket, as the one shown in Figure, 1, which shows the pocket cut (TT), the edges (F) of the pocket cut (TT), the upper part (PS) and the lower part (P1) of the pocket cut (TT).

Figure 1:
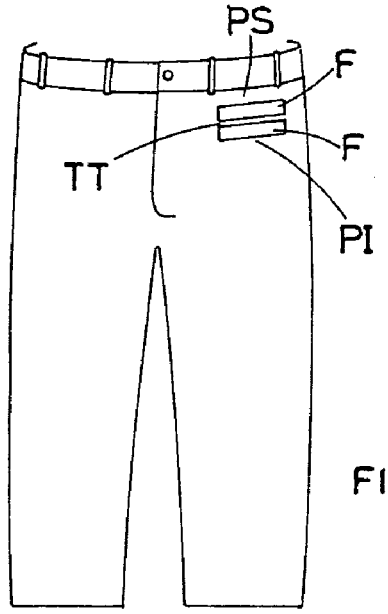
FIG. 1 is a diagrammatic view of a pair of pants with a slash pocket with two edges, one over and one under the pocket cut.
Figure 2:
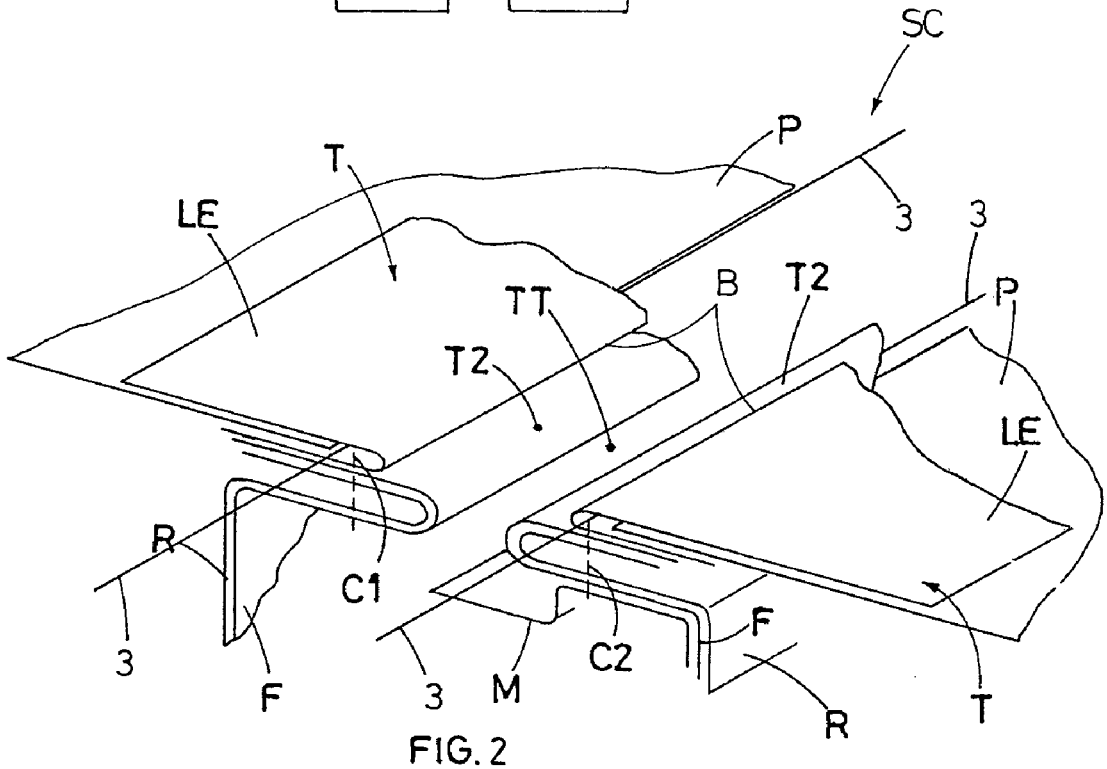
FIG. 2 is a transversal cross-section of the slash pocket with edges in reversed position inside the pocket cut and ready to be ironed.
Figure 3:
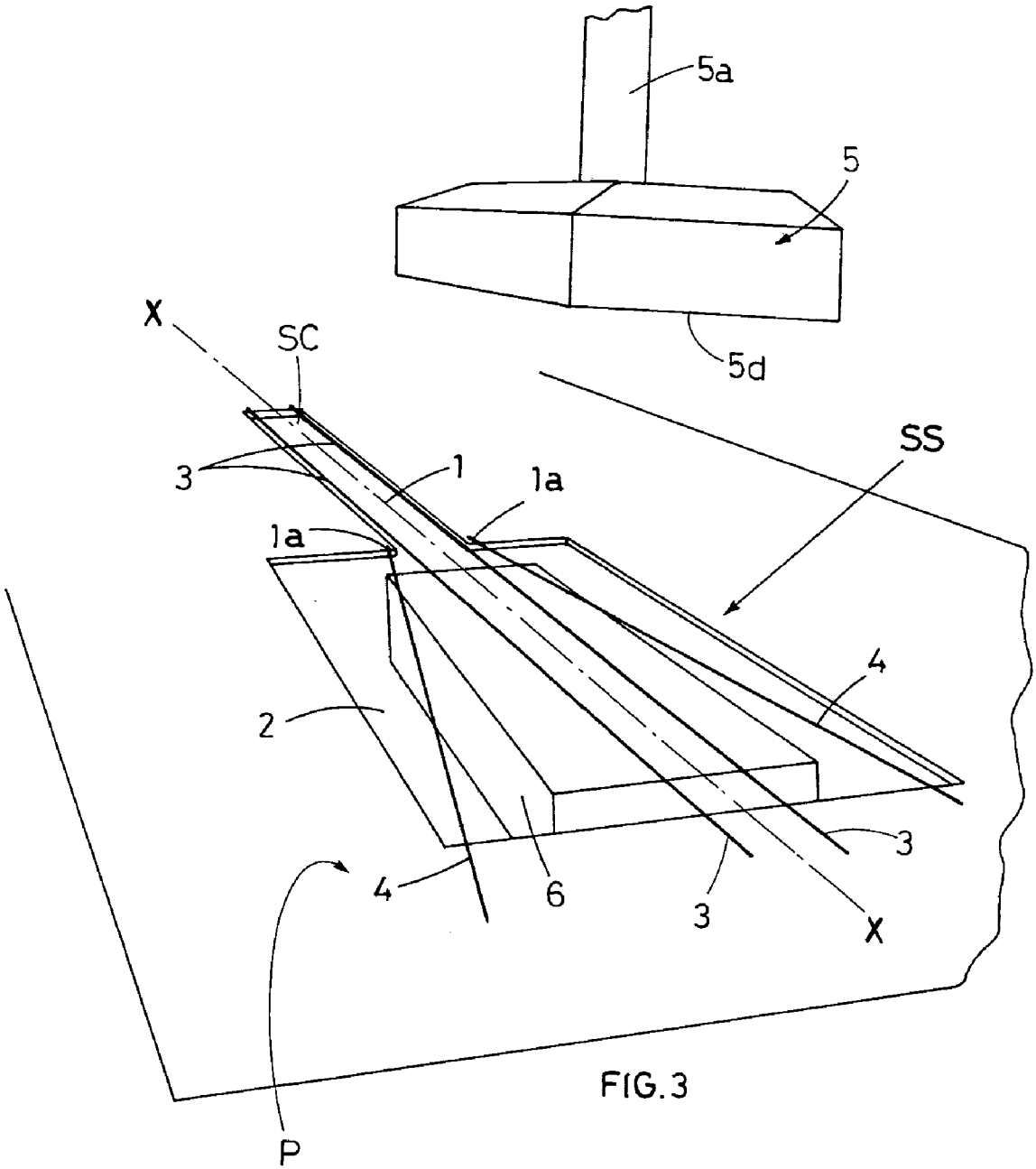
FIG. 3 is a perspective diagrammatic view of the ironing station of the machine of the invention.

FIG. 2 shows the loading station (SC) upstream of the ironing station (SS) shown in FIG. 3.

At the loading station (SC) the item with the pocket to be ironed is placed as illustrated in FIG. 2, which diagrammatically shows both a portion of the worktop (P) and a portion of the pocket mouth sectioned with a vertical plane orthogonal to the pocket cut (TT).

The pocket cut (TT) is bordered and finished by a pair of parallel edges (F) with reinforcements (R), while a facing (M) is designed to internally cover the mouth of the pocket.

As shown in FIG. 2, the item is placed over the worktop (P) with the fabric (T) with the pocket having its external side (LE) up.

Two seams (C1, C2) run parallel and equidistant on the fabric (T) with respect to the pocket cut (TT); the seam (C2) is situated on the upper part (PS) of the pocket cut (TT) and affects the facing (M), the edge (F) and the reinforcement (R), while the seam (C1) is situated on the lower part (PI) of the pocket cut (TT) and affects the edge (F) and relevant reinforcement (R), as shown in FIG. 2.

In FIG. 2, (T2) identifies the folded sections of the reinforcement (R) and edge (F) that go over the seams (C1 and C2) and extend towards the pocket cut (TT).

In view of the above, this description continues with a detailed illustration of the machine used to implement the ironing process of the invention.

The machine is provided with a worktop (P) with a slot (1) that extends from the loading station (SC) to the ironing station (SS), ending in a rectangular window (2) where the fabric (T) is transferred and held long enough to allow the ironing means (MS) to perform their function correctly.

As shown in FIG. 3, two pairs of threads (3 and 4) run on the worktop (P); the threads (3) of the first pair run inside the slot (1) and the window (2) in parallel position close to the border of the slot (1), while the threads (4) of the second pair are only extended in the window (2).

More precisely, the threads (4) of the second pair are respectively fixed to the connection vertexes (1*a*) between the slot (1) and the window (2) and continue with diverging direction through the window (2), as shown in FIG. 3.

The fabric (T) is transferred from the loading station (SC) to the ironing station (SS) by means of transport blades of known type, which drag the fabric (T) over the worktop (P) along a direction that coincides with the longitudinal axis (X—X) of the slot (1), which is the same as the axis of the pocket cut (TT).

After the pocket has been placed in the loading station (SC), the first pair of threads (3) is situated under the fabric (T), and more precisely inside the fold (B) on the fabric (T) near the seams (C1 and C2), as shown in FIG. 2.

The position of the threads (3) guarantees that the position of the edges (F) with relevant reinforcements (R) and the position of the facing (M) are perfectly maintained while the item is transferred from the loading station (SC) to the ironing station (SS), that is to say that the folding lines (B) maintain the distance and the parallel position with respect to the axis X—X of the slot (1).

The second pair of threads (4), that is to say the threads situated in the window (2), guarantee the perfect ironing of the pocket, since the threads (4) support the fabric (T) inside the window (2).

The ironing means (MS) include an overlapped pair of buffers (5 and 6) situated respectively over and under the worktop (P) in the window (2), both of them being supported by a jack (5*a* and 6*a*) that allows them to move vertically.

The vertical travels of the lower buffer (6) are smaller than the travels of the upper buffer (5), it being understood that the two buffers mutually adhere on a plane coplanar to the worktop (P).

The lower buffer (6) in idle position is slightly lower with respect to the pair of threads (3 and 4) so as not to interfere with the correct position of the pieces of fabric (F, R, M) in the ironing station (SS), and particularly inside the window (2).

The lower buffer (6) is padded with silicone or honeycomb soft material of known type.

The upper buffer (5) includes a central body (5*b*) having basically the same dimensions as the lower buffer (6), and, as shown in FIGS. 4 to 7, laterally provided with an opposite pair of jacks (5*c*) with horizontal axis, which support and actuate a pair of divaricating plates (7) folded with L-shape so as to partially cover the lower face (5*d*) of the central body (5*b*) with their horizontal wings (7*a*).

In the preferred embodiment of the invention, the horizontal wings (7*a*) have arched convex longitudinal borders (7*b*), so that the adherence points to the fabric (T) are closer to the pocket cut (TT) in the centre and farther from the pocket cut (TT) at the ends.

The presence of the arched shape is due to the need to adjust the ironing tension of the pieces of fabric (F, R, M, T), which must be higher in the central section of the pocket cut (TT), where the fabric can give way more easily, and lower in the ending sections of the pocket cut (TT), where ironing encounters some resistance in the continuity of the fabric (T) and in the seams at the two ends of the pocket cut (TT).

When the upper buffer descends over the lower buffer, the divaricating plates (7) press the pieces of fabric (T, F, R, M) situated between the two buffers (5 and 6) and then open out following to the activation of the jacks (5*c*).

Once the plates (7) have divaricated, the upper buffer (5) irons the pieces of fabric (T, F, R, M) with steam jets coming out of a series of holes drilled on the lower side (5*d*) of the central body (5*b*), which, according to a known construction, includes channels with valves to distribute and dispense steam through the said holes.

Once the dispensing of steam has ceased, the lower buffer (6) aspirates the steam dispensed by the upper buffer (5) by means of a series of upper holes.

Also the lower buffer (6) has a conventional construction, with a perforated surface and internal channels used to aspirate the steam dispensed by the upper buffer.

The ironing process includes nine operational steps, which are now illustrated in detail with reference to FIGS. 4 to 7, which, for easier graphical reference, show the position of the ironing means (MS) at each operational step and not the pieces of fabric (T, R, F, M) to be ironed.

The worktop (P) is not sectioned in FIGS. 4 to 7, which is only shown with a line (P1).

During the nine operational steps the buffers (5 and 6), the divaricating plates (7) and the threads (3 and 4) cooperate to iron the fabric (T), edges (F), reinformcements (R), and facing (M).

Figures 4, 5, 6, 7:
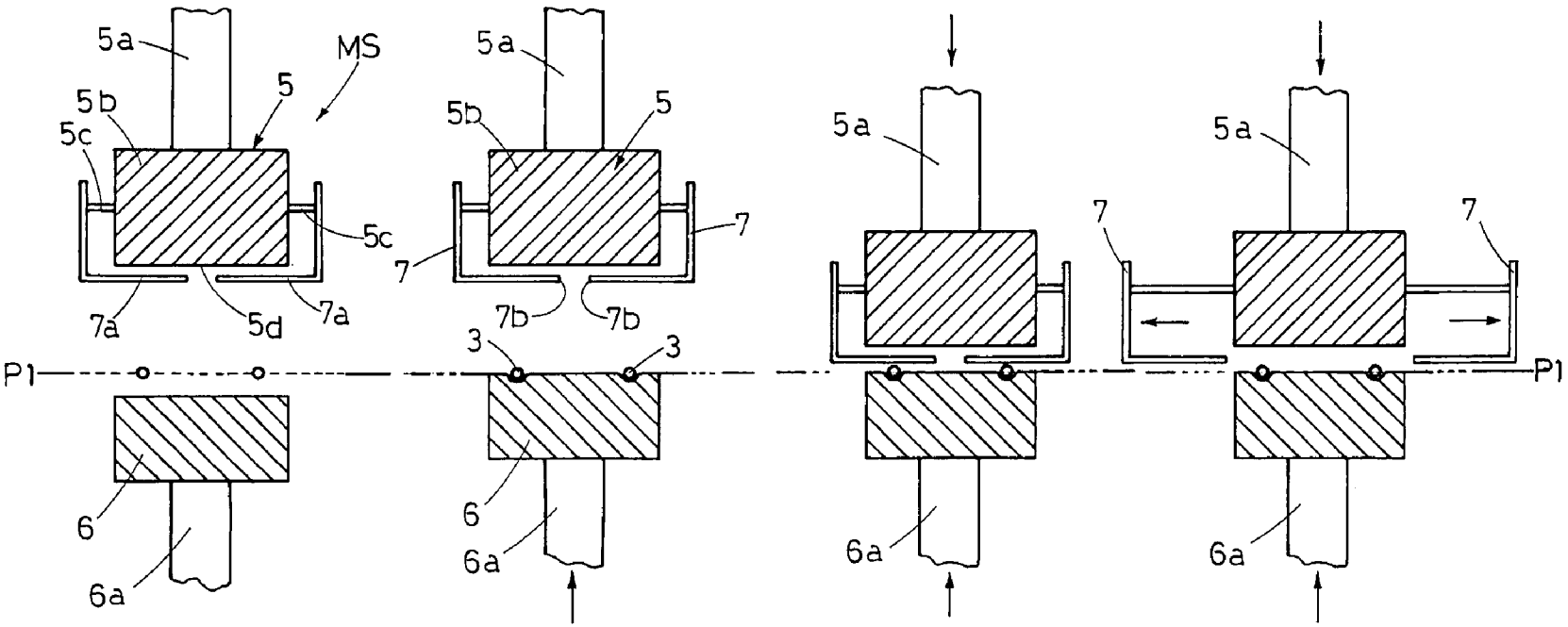
FIGS. 4 to 7 are cross-sections with a transversal vertical plane of the two ironing buffers, each of them showing the position of the said buffers in the different steps of the ironing process.

The process includes the following sequences of operational steps:

a) raising of the lower buffer (6) until it slightly presses the threads (3) that partially sink in the soft surface of the buffer (6) (see FIG. 5);

b) descending of the upper buffer (5) with the divaricating plates (7) in retracted position, until it adheres on the lower buffer (6) (see FIG. 6);

c) divarication of the plates (7) (see FIG. 7);

d) downward pressing of the upper buffer (5) and steam dispensing through the series of holes located on the lower face (5*d*) of the central body (5*b*) of the upper buffer (5);

e) interruption of steam dispensing;

f) steam and air aspiration by the lower buffer (6) through the said series of holes situated on the upper face;

g) interruption of steam and air aspiration;

h) raising of the upper buffer (5) to the idle position at the end of the upward travel and retraction of the divaricating plates (7);

i) descending of the lower buffer (6) until it has reached the idle position (see FIG. 4).

The invention claimed is:

1. Machine for the automatic ironing of the edges of slash pockets, characterised in that it comprises:

a worktop (P) with two operational stations, that is to say a loading station (SC) and an ironing station (SS), which communicate through a slot (1) on the worktop (P) starting from the loading station (SC) and ending into a large window (2) on the worktop (P) at the ironing station (SS);

a parallel pair of extended threads (3) that run inside the slot (1) and the window (2) in parallel close position with respect to the border of the slot (1);

ironing means (MS) composed of a pair of buffer (5 and 6), situated over and under the worktop (P), respectively, in the window (2), both being supported by a jack (5*a* and 6*a*) that drags them in alternate vertical travels, where the upper buffer (5) has holes on the lower surface (5*d*) to dispense steam and is provided with divaricating plates (7), while the lower buffer (6) has holes on the upper surface to aspirate air and steam.

2. Machine for the automatic ironing of the edges of slash pockets, as defined in claim 1, characterised in that it comprises a second pair of threads (4) fixed respectively to the connection vertexes (l*a*) between the slot (1) and the window (2) and crossing the window (2) with diverging direction.

3. Machine for the automatic ironing of the edges of slash pockets, as defined in claim 1, characterised in that it comprises means for the automatic transfer of the fabric (7) to be ironed from the loading station (SC) to the ironing station (SS).

4. Machine for the automatic ironing of the edges of slash pockets, as defined in claim 3, characterised in that the means for the automatic transfer of the fabric (T) to be ironed from the loading station (SC), to the ironing station (SS) consist in transportation blades.

5. Machine for the automatic ironing of the edges of slash pockets, as defined in claim 1, characterised in that the divaricating plates (7) each having an L-shape with a leg (7*a*) are actuated by relevant jacks (5*c*) so as to partially cover the lower faee surface (5*d*) of the upper buffer with the leg (7*a*).

6. Machine for the automatic ironing of the edges of slash pockets, as defined in claim 5, characterised in that the leg (7*a*) have arched convex longitudinal borders (7*b*).

7. Ironing process for the edges of slash pockets by means of a machine having an ironing means (MS) composed of an upper buffer (5) and a lower buffer (6). situated over and under a worktop (P). respectively, both being supported by a jack (5*a* and 6*a*) that drags them in alternate vertical travels, where the upper buffer (5) has a series of holes on a lower surface (5d) to dispense steam and is provided with divaricating plates (7). while the lower buffer (6) has a soft surface and a series of holes on an upper face to aspirate air and steam, characterised in that it comprises the following sequence of operational steps:

a) raising of the lower buffer (6) until it slightly presses the threads (3) that partially sink in the soft surface of the buffer (6);

b) descending of the upper buffer (5) with the divaricating plates (7) in retracted position, until it adheres on the lower buffer (6);

c) divarication of the plates (7);

d) downward pressing of the upper buffer (5) and steam dispensing through the series of holes located on the lower surface (5*d*) of the upper buffer (5);

e) interruption of steam dispensing;

f) steam and air aspiration by the lower buffer (6) through the said series of holes situated on the upper face;

g) interruption of steam and air aspiration;

h) raising of the upper buffer (5) to an idle position at the end of the upward travel and retraction of the divaricating plates (7);

i) descending of the lower buffer (6) until it has reached the idle position.

* * * * *